US005311716A

United States Patent [19]

Houssin

[11] Patent Number: 5,311,716

[45] Date of Patent: May 17, 1994

[54] WATERPROOF COVERING DEVICE FOR A ROOF OR THE LIKE

[75] Inventor: Emmanuel Houssin, Paris, France

[73] Assignee: Siplast, S.A., Paris Cedex, France

[21] Appl. No.: 2,901

[22] Filed: Jan. 11, 1993

[30] Foreign Application Priority Data

Jan. 24, 1992 [FR] France ..... 92 00777

[51] Int. Cl.[5] ..... E04B 7/00

[52] U.S. Cl. ..... 52/410; 52/478; 52/588

[58] Field of Search ..... 52/408, 410, 409, 412, 52/478, 588

[56] References Cited

U.S. PATENT DOCUMENTS

| | | | |
|---|---|---|---|
| 2,388,968 | 11/1945 | Hedgren | 52/409 |
| 2,959,897 | 11/1960 | Baker | 52/410 |
| 3,606,720 | 9/1971 | Cookson | 52/478 |
| 3,765,140 | 10/1973 | Harry | 52/409 |
| 4,441,295 | 4/1984 | Kelly . | |
| 4,494,343 | 1/1985 | Berry et al. | 52/410 |

FOREIGN PATENT DOCUMENTS

| | | | |
|---|---|---|---|
| 2396849 | 3/1979 | France | 52/409 |

*Primary Examiner*—Michael Safavi
*Attorney, Agent, or Firm*—Pollock, VandeSande & Priddy

[57] ABSTRACT

A corrugated waterproof roof covering has a plurality of adjacently positioned sections. Each section includes an intermediate series of separated, adjacently positioned ridges interconnected by identical U-shaped channels. An additional lowered ridge is located at a first end of the series of ridges and appends from them by an L-shaped channel. An outer edge of the lowered ridge appends to a shallow U-shaped channel. The sections are positioned in edgewise overlying relation. An end ridge at a second end of each section overlies and receives the lowered ridge of an adjacent section to create a passageway therebetween and to laterally interlock the sections. A protective layer is positioned atop the rides, and fasteners extend through the layer for termination in the passageway for concealing the fasteners from view.

7 Claims, 3 Drawing Sheets

WATERPROOF COVERING DEVICE FOR A ROOF OR THE LIKE

FIELD OF THE INVENTION

The present invention relates to a waterproof covering device for a roof, particularly of industrial buildings, comprising a supporting element, usually a metal plate and, on top of the latter, an insulating layer which is itself covered with a waterproofing lining, protecting the assembly from the effects of bad weather in particular.

BACKGROUND OF THE INVENTION

Covering devices of this type which comprise a metal support plate, resting on appropriate bearing walls or purlins, this plate being associated on top and towards the outside of the premises thus covered, with a layer of insulating material having a suitable thickness and with a waterproof external lining in the form of sheets, covering the insulating layer, are already known. However, in the conventional solutions, in order to withstand the effects of compression or tearing which are exerted on the assembly, as a result of wind in particular, it is essential to join the metal plate and the external lining which trap the insulating layer between them, using mechanical connection means, such as screws, rivets, bolts or the like, which pass through the metal plate in order to interact with an appropriate fastening member such as nuts, washers, counter-rivets, clips or the like, ensuring a suitable and safe locking of the elements thus joined.

In general, these solutions require the sheet, usually made of a bituminous material forming the water-proofing lining, to be pierced for the passage of the fixing bolt or screw whose head rests on a metal washer bearing on the external surface of this lining, this screw then passing through the insulating layer and finally the support plate so as to ensure screwing on its protruding extremity. Notably, and in the most common way, these solutions do not require a tapping hole to be made for the passage of the fixing screws in the plate, these screws usually being of the "Parker" screw type, which are well known in the art.

However, it may then be desirable to cover the assembly with a second waterproofing sheet extending either over the whole surface of the lining, or only at the site of the screw heads, the lining sheet or sheets being applied over the insulating layer which, preferably, is formed of juxtaposed panels, resting against the supporting metal plate. As a variant, a first sheet of the insulating lining may be unrolled dry over the insulating panels and fixed to the plate by means of through screws as described above, and the external waterproof lining may then be adhesively bonded or welded, if need be while protecting the underlying insulating panels from the heat, or the fixing screws may also be installed at the location where the various sheet widths forming this lining overlap, the edge of each width being adhesively bonded or welded on the border of the edge of the adjacent width, covering the metal bearing washers of the screw heads.

In all cases, the fixing screws, rivets or bolts pass in principle through the plate and require the latter to be pierced, which constitutes a drawback. To overcome this, it is possible to envisage, either ensuring the essential mechanical connection by making anchoring grooves and ribs in the external face of the plate, which has for example a dovetail-shaped profile for bolt heads whose threaded end, which protrudes outwards after passing through the insulating layer, interacts with appropriate locking components, which constitutes a costly and impractical solution which complicates in particular the installation and assembly of the roof covering, or alternatively welding these bolts directly to the external face of the plate against which the insulating panels bear.

However, in either of these solutions, either as a result of the piercing of the plate, or because of the welding of the bolt or of the means for immobilizing the latter, the other face of the plate which constitutes the ceiling of the covered premises is impaired, the holes leaving unattractive markings, whereas the welding of the bolts introduces burn marks, which is unacceptable, particular if the corresponding surface of the plate has been prelacquered.

It is therefore essential to install an added false ceiling under the plate, which is once again a costly solution and requires considerable labour time for its installation and fixing.

BRIEF DESCRIPTION OF THE INVENTION

The present invention relates to a covering device for a roof which avoids these drawbacks, by providing a connection which is safe, rapidly assembled and of a reduced cost, between the metal support plates and an external waterproofing lining in the form of sheets, through an insulating layer placed between this plate and this lining as in the state of the art, but while eliminating the unattractive effect at the underside of the plates of the piercing of the latter, the connection produced being made invisible.

For this purpose, the device in question, comprising a supporting element consisting of an assembly of contiguous metal plates, an insulating layer applied against the external face of the supporting element, which layer is preferably formed by the juxtaposition of insulating panels resting on the plates and an external waterproofing lining, laid against the insulating layer, as well as mechanical connection means bearing on the external lining or on the insulating layer, and passing through the latter. If need be, that plate of the supporting element which is located directly opposite, is characterized in that the contiguous plates of the said supporting element comprise edges which are mutually superimposed from one plate to the next in a marginal overlapping zone, these plates comprising, at least in these edges, ribs having different heights, respectively in the edge of a first plate and in the adjacent edge of a second plate covered by the first one. This serves to delimit, between these ribs which are fitted inside each other in the said zone, a closed housing in which extends the end part of the connection means after passing through the first plate and with which a locking and immobilizing member may possibly be associated, the two edges of any plate of the supporting element comprising, for one, a rib of greater height and for the other, contrary to the first, a rib of smaller height.

In a preferred embodiment of the invention, the mechanical connection means consist of a screw, rivet, bolt or the like, comprising an extremity and a washer for bearing against the external surface of the waterproof lining and an end part which is threaded and welded to the plate or passing through it in order to be locked in the closed housing delimited between the ribs of the edges of two contiguous plates. As a variant, particularly when the connection means consists of a bolt, the end of the latter is also threaded and interacts with another locking and immobilizing nut, or is welded to the plate at the site of the housing.

In all cases, the difference in the heights of the ribs of the edges of the contiguous plates in the marginal zone where the latter overlap is at least equal to the length of the end part of the connection means and of the associated locking and immobilizing member.

Furthermore, it is clear that the device according to the invention may be applied regardless of the nature and in particular the width of the adjacent panels forming the insulating layer, the thickness of these panels determining the height of the screws or bolts forming the fixing means. Likewise, the water-proofing lining may be made from a single sheet or from several superimposed sheets. It is preferably formed of successive widths which overlap mutually from one width to the next, advantageously at the site of the fixing means.

Other features of a waterproof covering device for a roof or the like established in accordance with the invention, will further emerge from the following description of several illustrative embodiments, given by way of information and in a non-limiting manner, with reference to the attached drawings in which:

BRIEF DESCRIPTION OF THE FIGURES

In FIG. 1, the reference 1 designates a waterproof covering device for a roof or the like according to the invention, this device being particularly intended to form the ceiling of a premises by resting on support purlins 2 extending transversely from supporting walls such as 3.

Figure 1:
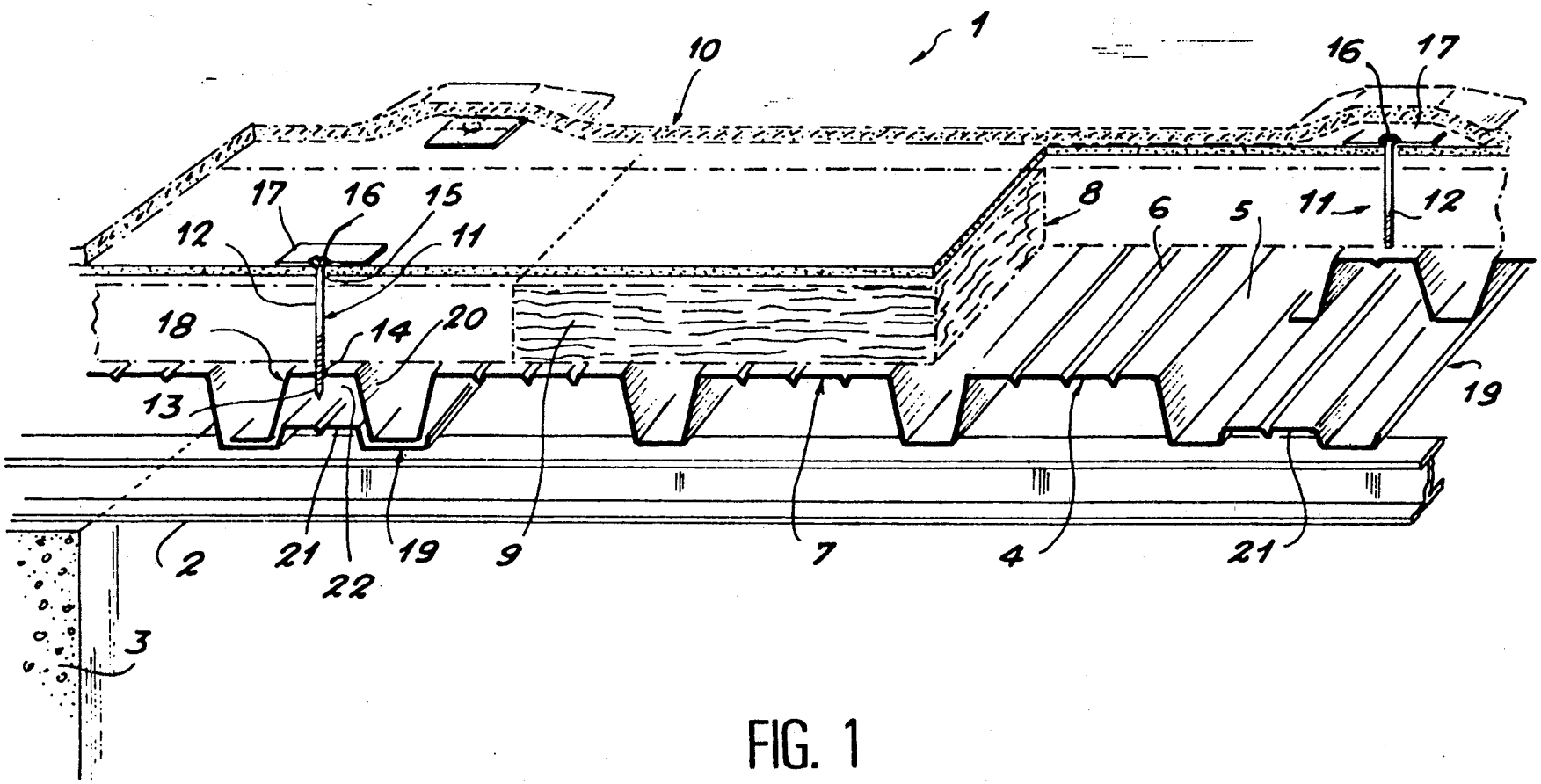
FIG. 1 is a perspective view with cross-section and partial removal of a first embodiment of the invention.

In a manner which is itself known in the art for this type of construction, the covering 1 consists of a supporting element 4, formed of contiguous metal plates 5, each of these plates preferably comprising in its ordinary part stiffening folds or channels 6 and, in places, depending on the transverse dimension of the plate 5, ribs 7 of greater height, enabling in particular the plates to bear on the purlins 2 which support them.

The supporting element 4 carries, for its part, an insulating layer 8, formed advantageously by means of an assembly of parallelepipedal panels 9, laid side by side over the whole surface area of the covering device 1, bearing on the external surface of the plates 5. These panels may be made of any appropriate insulating material, for example of rigidified plastic foam, particularly of polystyrene, or even of polyurethane or any other common material, such as mineral wool or another similar product such as those known in the art under the names of "Perlite" or "Ré sol" foam.

Finally, the layer 8 comprises on top a waterproof lining 10, advantageously formed by means of one or more layers made up of sheets of a bituminous material, unrolled over the insulating layer and welded or adhesively bonded at the border from one sheet to the next by heating with a welding torch or following any other method which is conventional in the art.

In a manner which is also conventional in the production of such covering devices, the supporting element 4 and the external waterproof lining 10 are joined by mechanical connection means 11 which extend perpendicularly to the plane of the plates 5, the insulating layer 8 thus being trapped between them. In the illustrative embodiment shown in FIG. 1, these connection means are in the form of screws or bolts 12 whose end part 13 directed towards the corresponding plate 5 is threaded at 14, passing furthermore through the plate so as to emerge slightly below the latter. When the fixing means is a screw, as in the usual case, its opposite extremity 15 is widened at 16 and bears on a small immobilizing and locking plate-like element 17, holding the waterproofing lining. When the fixing means is a bolt, it is possible in the same way to provide a locking nut (not shown here) at the corresponding threaded extremity.

In accordance with the invention, the plates 5 forming the supporting element 4 are shaped during their manufacture so that they exhibit in their opposite edges, 18 and 19 respectively, a different profile with on one side, for example in the edge 18 in the Figure, a rib 20 having a height which is considerable and in particular equal to that of the ribs 7 in the ordinary part of the plate, and a rib 21 of smaller height in the opposite edge 19.

By virtue of these arrangements, the partial overlapping or lapjoint of the edges 18 and 19 respectively of two contiguous plates 5 in the supporting element 4, delimits by means of the ribs 20 and 21 provided in these edges and between these ribs as a result of their different heights, a closed housing 22 into which particularly the end part 13 of the threaded screw or of the bolt 12 penetrates.

Thus, and as a result of this overlapping and particularly of the fact that the edge 19 of one of the plates is housed under the edge 18 of the adjacent plate while the ribs 20 and 21 fit mutually inside each other, the inside of the housing 22 becomes totally invisible from the outside and particularly from below the covering device inside the premises over which it is located In particular, any holes made in the plates for the passage of the end parts 13 of the screws 12, even the burn marks or any welding deposits in the solution using bolts welded against the plate 5, cannot be seen in the ceiling of the premises, which remains perfectly clean, particularly if the plates 5 have undergone an appropriate painting or prelacquering treatment before being assembled.

Figure 2:
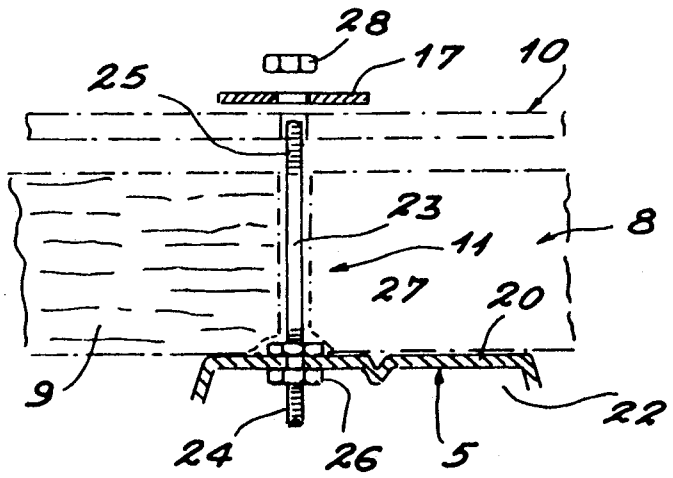
FIG. 2 is a section on a larger scale of a detail of FIG. 1, depicting a variant of the connection means employed.

In the variant depicted in FIG. 2, the connection means 11 between a plate 5 and the external waterproof lining 10, trapping the panels 9 of the insulating layer 8, are in the form of a rod 23 which, in this variant, is threaded, not only at its end part 24 which penetrates into the housing 22 under the crest of the rib 20, but also at its opposite extremity 25 forming the head and which passes through the lining 10. In this variant, these two threaded extremities 24 and 25 interact respectively with a nut 26 and a counter-nut 27 for the extremity 24, locking the rod 23 with respect to the plate 5, the other extremity 25 interacting with another nut 28 bearing on the small plate-like element or washer 17.

Figure 3:
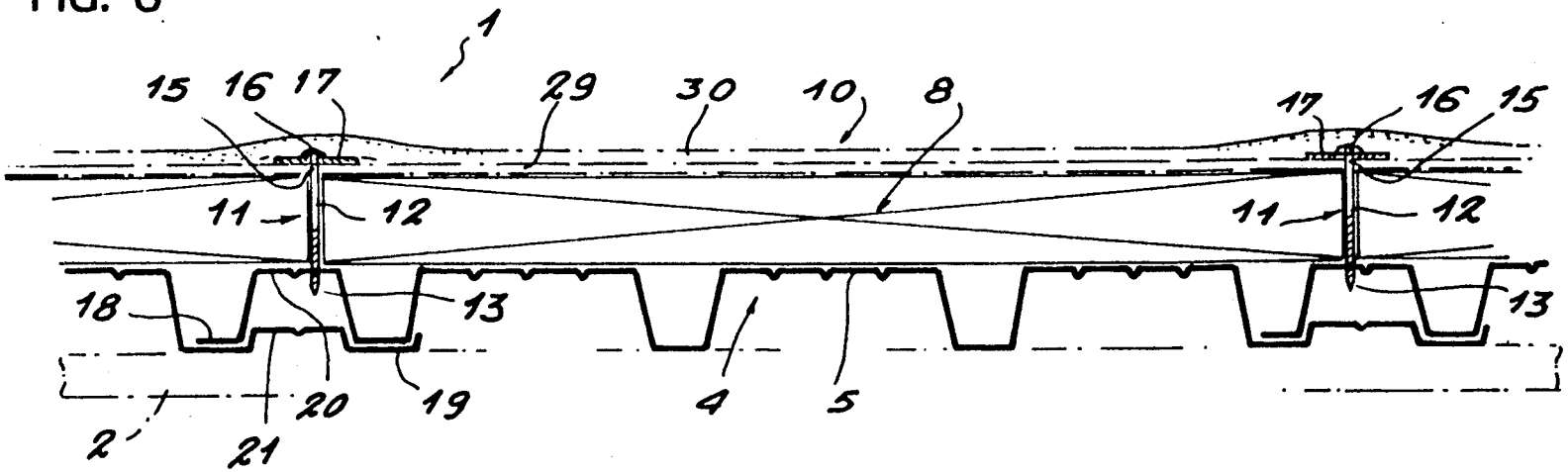
FIGS. 3, 4 and 5 are diagrammatical cross-sections of different embodiments of the waterproof lining placed on the top of the device, protecting the connection means.
Figure 4:
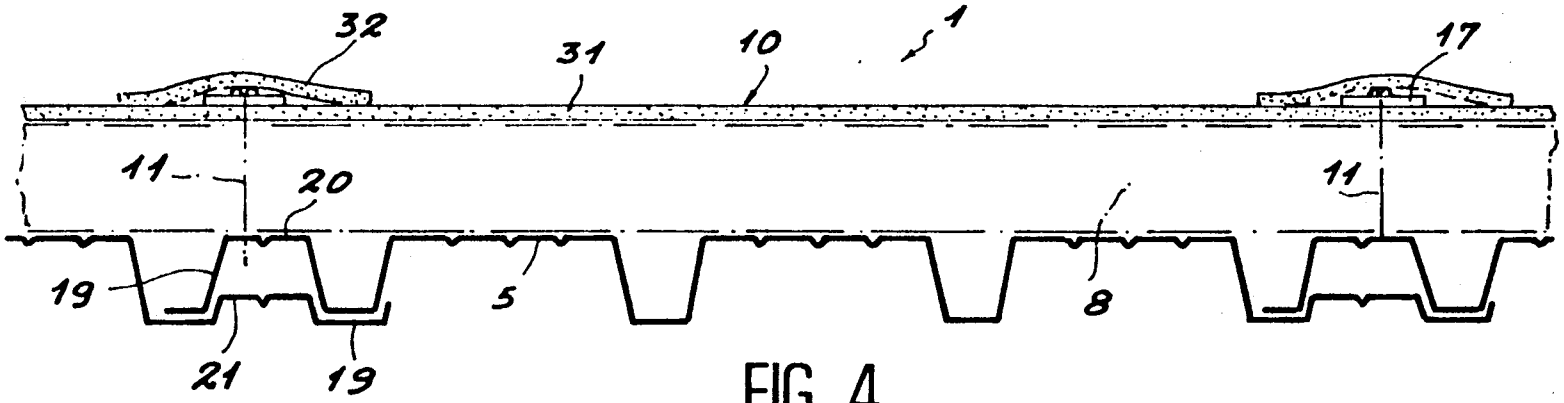
Figure 5:
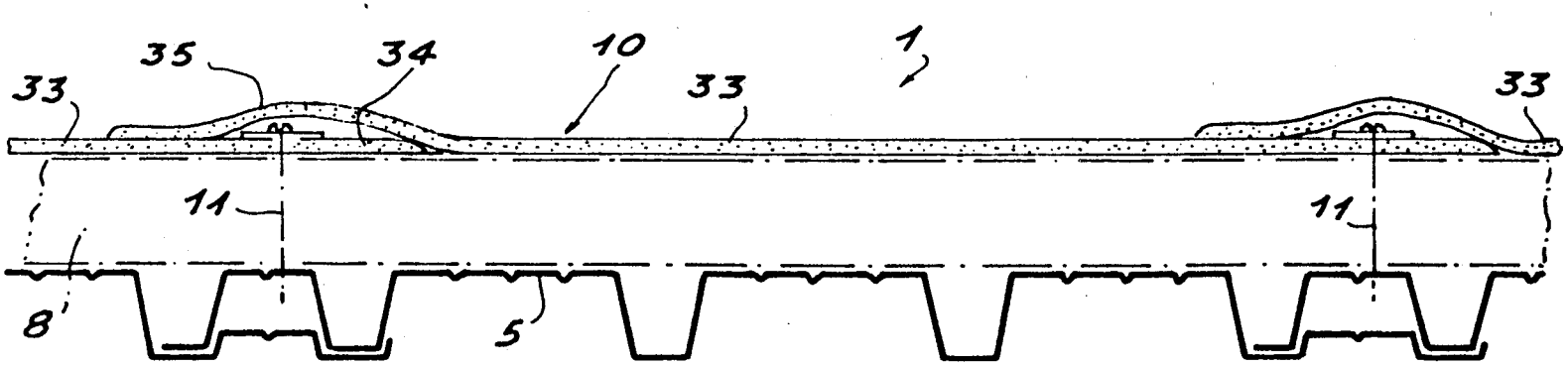

FIGS. 3, 4 and 5 depict various other variants using particularly solutions which differ from each other as regards the waterproof lining 10 laid towards the outside of the covering device.

In the example in FIG. 3, this lining is formed of a first layer 29 which, at the site of the connection means 11, is pierced by the corresponding threaded rods or bolts, this layer, made of bituminous material, being itself lined with a second similar layer 30, which covers the fixing means or elements, regardless of the embodiment envisaged for the latter.

In FIG. 4, the waterproof lining 10 comprises a single layer 31 similar to the first layer 29 of the previous example, the end nuts or heads of the bolts or rods of the connection means 11 being covered by portions or components 32 of appropriate dimensions and of identical nature, which are welded or adhesively bonded around their perimeter to the layer 31.

Finally, in the variant according to FIG. 5, the external lining 10 is formed of successive strips or sheets 33, one of the edges 34 of which is applied against the insulating layer 8 and is pierced by the connection means 11 at the locations where the latter are inserted, the other edge 35 of the neighboring sheet overlapping this edge 34 of the sheet, covering the head or end extremity of the corresponding connection means.

A waterproof covering device is thus produced for a roof or the like which is of simple design and which makes it possible to ensure a safe and efficient fixing of the supporting element and of the external waterproof lining through the insulating layer, without the holes pierced in the plates which form this supporting element or the marks of welding carried out on these plates being visible from the outside and in particular from below the device, thereby avoiding the need of assembling, under the latter, an additional partition making up a false ceiling.

The panels forming the insulating layer may have any dimensions, if need be close to those of the plates while being juxtaposed or offset with respect to the edges of the latter Likewise, the thickness of these panels may be adapted depending on the circumstances under which the covering is to be used, the length of the bolts or rods forming the connection means being adapted to each particular case.

In all cases, the heights of the ribs, respectively on either side of the plates, which fit inside each other from one plate to the next so as to delimit the closed housings, are chosen so that their difference corresponds approximately to the overall size of the protruding end extremity of the connection means and, if necessary, to the nuts and other locking members which interact with these extremities.

Finally, it goes without saying that the distribution of the connection means through the supporting element may vary from one embodiment to the next depending on the size of the stresses to which the structure is likely to be subjected.

Under these conditions, it must be understood that the invention is not limited to the embodiment more especially described above with reference to the attached drawings; on the contrary, it encompasses all the variants thereof. In particular, it is possible to envisage that the plates of the supporting element are planar at their ordinary part and comprise ribs only on their edges in order to produce the closed housings concealing the protruding or welded extremities of the fixing bolts.

I claim:

1. A corrugated waterproof roof covering having a plurality of adjacently positioned sections, each section comprising:

an intermediate series of separated, adjacently positioned ridges interconnected by identical U-shaped channels;

an additional lowered ridge located at a first end of the series of ridges and appending therefrom by an L-shaped channel;

an outer edge of the lowered ridge appending to a shallow U-shaped channel;

the sections positioned in edgewise overlying relation;

an nd ridge at a second end of each section overlying and receiving the lowered ridge of an adjacent section to create a passageway therebetween and to laterally interlock the sections;

a protective layer positioned atop the ridges; and a plurality of fasteners, each of which extends through the layer for termination in the passageway and concealment of the fasteners from sight, as viewed in a direction opposite the layer.

2. The covering set forth in claim 1 wherein the shallow U-shaped channel has a base section slightly larger than that of the U-shaped channel for receiving a correspondingly positioned U-shaped channel of an overlying interlocked section.

3. The covering set forth in claim 1 wherein the lowered ridge are narrow relative to the intermediate series of ridges.

4. The covering set forth in claim 1 wherein the fasteners are threaded and clamping the protective layer against the ridges while remaining invisible when viewed from a direction opposite the layer.

5. The covering set forth in claim 1 wherein the height of the passageway is greater than a projection of the fastener into the passageway.

6. The covering set forth in claim 1 wherein the layer is divided into adjacent sheets which have overlapping seams in areas occupied by the fasteners.

7. A corrugated waterproof roof covering having a plurality of adjacently positioned sections, each section comprising:

an intermediate series of separated, adjacently positioned ridges interconnected by identical U-shaped channels;

an additional lowered ridge located at a first end of the series of ridges and appending therefrom by an L-shaped channel;

an outer edge of the lowered ridge appending to a shallow U-shaped channel;

the sections positioned in edgewise overlying relation;

the shallow U-shaped channel having a base section slightly larger than that of the U-shaped channel for receiving a correspondingly positioned U-shaped channel of an overlying interlocked section;

an end ridge at a second end of each section overlying and receiving the lowered ridge of an adjacent section to create a passageway therebetween and to laterally interlock the sections;

the lowered ridge and the end ridge being narrow relative to the intermediate series of ridges.

a protective layer positioned atop the ridges; and a plurality of fasteners each of which passes through the layer for termination in the passageway and concealment of the fasteners from sight, when viewed in a direction opposite the layer;

the fasteners being threaded and clamping the protective layer against the roof covering while remaining invisible from a direction opposite the layer; wherein the height of the passageway is greater than a projection of the fasteners into the passageway.

* * * * *